United States Patent [19]

Reitlinger

[11] 4,026,739

[45] May 31, 1977

[54] LIQUID MONOPROPELLANTS OF REDUCED SHOCK SENSITIVITY AND EXPLODABILITY

[75] Inventor: Otto Reitlinger, Arlington, Va.

[73] Assignee: The United States of America as represented by the Secretary of the Navy, Washington, D.C.

[22] Filed: Nov. 29, 1963

[21] Appl. No.: 327,151

[52] U.S. Cl. ..... 149/88
[51] Int. Cl.[2] ..... C06B 25/00
[58] Field of Search ..... 149/88, 89, 90, 91

[56] References Cited

UNITED STATES PATENTS 3,116,188 12/1963 Austin ..... 149/101

OTHER PUBLICATIONS

"Military Explosives", TM9-191s; TD 11A-1-34-:Depts of the Army & Air Force, (Apr. 1955), p. 241.

*Primary Examiner*—Edward A. Miller

EXEMPLARY CLAIM

1. A liquid monopropellant comprising an aliphatic dinitrate ester selected from dinitroxyethane, dinitroxypropane, dinitroxybutane and dinitroxypentane and mixtures thereof with di-2, ethyl-n-hexyl sebacate.

2 Claims, No Drawings

LIQUID MONOPROPELLANTS OF REDUCED SHOCK SENSITIVITY AND EXPLODABILITY

The invention described herein may be manufactured and used by or for the Government of the United States of America for governmental purposes without the payment of any royalties thereon or therefor.

The present invention relates to liquid monopropellants of reduced shock sensitivity and explodability, which can be used on board ships without endangering the safety of ships and personnel.

The advantages of liquid, nonexplosive, monopropellants over solid propellants and over liquid bi-propellant and tri-propellant systems are:

1. The mass flow of a liquid monopropellant can be varied according to requirements, i.e., increased for operations at greater depths and/or at greater speed of torpedoes when pursuing, and decreased when searching for direction of aim and/or rising to shallow courses near the surface.

2. Propulsion can be completely stopped and restarted by reigniting the flame.

3. The propulsion by solid propellants can be regulated only by venting the excess of the generated gases overboard. The performance cannot be interrupted and subsequently restarted. Once the propulsion has been started, it cannot be regulated at will.

4. The drawbacks of liquid bi-propellant and tri-propellant systems are caused by the practical impossibility of maintaining the ratio of the mass flows of the oxidizer and the fuel and diluent (in case of a tri-propellant system) constant, when changing the total mass flow, when changing depths and/or switching from search to pursuit. The ratio of the two or three propellants controls the performance, which becomes unpredictable when this ratio cannot be kept constant.

5. The liquid monopropellant incorporates the oxidizer, the fuel and the excess of fuel, which acts as diluent at a predetermined ration, and is not subject to mass flow ratio changes and thus the performance of the missile becomes predetermined and predictable, which is one of the principle prerequisities for the homing of any type of missile.

The limitation of the energy content for liquid monopropellants is dictated by the existing engines for torpedoes. These limitations are the temperature ceilings of 2000° F. for the gas before the nozzle of a turbine, and 2350° F. before entering a piston engine.

This limitation of the temperature of the generated gases implies a limited specific impulse of only about 207 seconds. This makes it possible to arrive at compositions the explodability and shock sensitivity of which is reduced to such extent that they become safe for use on board ships.

The criteria followed in the preparation of a suitable propellant having reduced shock sensitivity and explodability are:

1. The vapor pressure of the monopropellant must be as low as possible. The vapor pressure determines the percentage by volume of the energy generating compound in the surrounding gaseous phase when in equilibrium with the liquid and thus the sensibility to adiabatic compression and also to shock.

Thus, it is known that the initiation by impact, of explosion in liquids, is dependent on the vapor pressure. The initiation of explosion by the adiabatic compression is not limited to the compression of the gaseous phase on top of the liquid but occurs frequently by the adiabatic compression of the trapped gas bubbles in the liquid. And these gas bubbles in the liquid cannot be eliminated. They are always present. The water hammer effect caused by suddenly closing a valve can be sufficient to start an explosion if the vapor pressure is too high.

2. The overall oxygen balance of the propellant plus diluent must not differ by too much for the oxygen balance of the propellant as such. For example: With nitrogylcerol, which at 25° C. has a vapor pressure of only $1.77 \times 10^{-3}$ mm in the presence of a bubble as small as $5 \times 10^{-3}$ cm in radius, an explosion efficiency of 100% may be obtained with a 40g weight falling 10cm (400 g cm), while when no gas bubble is present very high energies of the order of $10^5$ to $10^6$ g cm are necessary for initiating an explosion. In other words: The amount of diluent which is necessary to be added to arrive at the desired oxygen balance should be as low as possible.

3. The diluent must be of very low solubility in water, i.e., insoluble for practical purposes. This prerequisite must be made absolutely mandatory if the propellant shall be contemplated to be used on board ships. For example: triacetin, which is generally used for diluting nitroglycerol and ethyleneglycol dinitrate, is soluble in water to the extent of 7 percent. Leakages of conveying lines in torpedoes and on ships are frequent. The spilled monopropellant is then flushed overboard. But residues remain in the cracks and corners and are depleted of their desensitizing diluent by its dissolving in the flushing water if the diluent is soluble in water. Thus, these residues become high explosive. They can be hydrolyzed and thus become innocuous by a lye solution. By employing a diluent which is insoluble in water, all these dangers and inconveniences are no longer to be considered.

4. The diluent must have the lowest vapor pressure possible, theoretically about the same vapor pressure as the propellant proper. If the diluent has a high vapor pressure or if its vapor pressure differs by too much from the vapor pressure of the propellant, stratification by fractional distillation and recondensation during extended storage will create two layers: one is depleted of the diluent and the other is the diluent. Thus, the very purpose of the diluent will be defeated.

5. The entire mixture, consisting of the liquid propellant proper, the diluent or diluents and the possible other ingredients, must have the flash point and flaming point sufficiently high so that at ambient temperatures and pressures the propellant mixture cannot be ignited in air. This is mandatory to avoid fire on board ship.

6. To obtain a self-sustaining decomposition flame without the addition of an oxygen donor in a reactor, a minimum pressure of about 100 psi is needed. In other words, it is necessary to prepressurize the reactor to start the decomposition flame and the decomposition flame is not sustained below this pressure. This criterion is imperative if the following or similar incidents are to be avoided: (1) The monopropellant decomposes when heated under pressure and, by definition, generates heat, and the liquid is transformed to gases having some hundred times larger volume. If the conveying lines are clogged for one reason or the other, and if the conveying lines near the reactor are not sufficiently cooled, the conveying lines will be burst by the formed gases. It is imperative that the decomposition flame in the conveying line be self-extinguished immediately when the pressure is released by the bursting of the line. Moreover, it must be made impossible to ignite the spilled monopropellant under normal conditions. This is imperative to avoid the loss of a ship and personnel.

This invention will be better understood by the following examples of compositions, which were made according to the preceding criteria, and by their performance:

EXAMPLE I

Composition I
Physical Properties and Performance Data

| | | |
|---|---|---|
| 1. | Consituents | % By Weight |
| | 1,2-dinitroxypropane | 76.0 |
| | 2-nitrodiphenylamine (NDPA) | 1.5 |
| | Tributyrin (TB) | 22.5 |
| 2. | Physical Properties | |
| | Density | 1.2694 g/ml, 25° C |
| | Freezing point | Below −20° C (−4° F) |
| | Vapor pressure of composition (calc) | 0.0877 mm at 25° C |
| | Vapor pressure of 1,2-dinitroxypropane | 0.09844 mm at 25° C |
| | Viscosity at 25° C | 3.79 centipoise |
| | Surface tension at 25° C | 34.26 + 0.03 dynes per cm |
| | Flash point | 115° C (239° F) |
| | Flaming point | 142° C (287.6° F) |
| 3. | Water content when dried | 0.008% |
| | Water content when water saturated | 0.026% |

4. Solubility of tributyrin in water: at 25° C less than 0.05% by weight, thus insoluble for practical purposes.

5. Characteristics of thermal decomposition:

a. Minimum pressure of ignition in nitrogen atmosphere, according to window bomb tests: 325 psi b. Minimum pressure at which a thrust motor could be actuated without pressure oscillations: 280 psi

| (c) Performance: | Computed: | Measured: |
|---|---|---|
| Temperature before nozzle | 1491° K (2224° F) | 2240° F |
| Isp (1000 psi) | 207.8 sec. | 197–204 sec. |

6. Results of Safety Tests:

a. Standard bullet impact tests, in glass lined containers: In 50 consecutive tests no explosion.

b. Standard card gap tests: *

In glass lined containers: no card at all, no explosions.

Without glass lining, three cards are necessary to present explosions.

* Described as Test No. 1 in Liquid Propellant Test Methods recommended by the Joint Army-Navy-Air Force Panel on Liquid Propellant Test Methods.

c. Adiabatic compression tests: ** 13.7 kg cm (kilogram centimeter), which compares with 6.7 kg cm, which is the value for propylnitrate for this test.

** Described as Test No. 5 in Liquid Propellant Test Methods.

The flash and flaming points both are very high, and in fact at normal pressure and temperature the fuel can only be ignited, when sprayed by a spray nozzle in oxygen, by a spark or blow torch. Otherwise, the reactor must be prepressurized to at least 120 psi for ignition of the spray.

Composition I was used to actuate thrust motors.

The standard bullet impact tests in glass lined containers were all negative: no explosions out of 50 tests.

The card gap tests in glass lined containers were negative without any card. Without glass lining, three cards are necessary to prevent explosions.

Improvements in safety may be obtained by changing the diluent, i.e., by replacing tributyrin with di-n-butylsebacate.

The thus obtained Composition II is presented as:

EXAMPLE II

The safety tests have been improved over Composition I by the following:

a. Card gap value in steel containers (not glass lined), from 3.8 cards to 0.4 cards.

b. Bullet impact tests negative also without glass lining of the container. Tests in steel containers were all negative, i.e. no explosions.

Composition II
Physical Properties and Performance Data

| | | |
|---|---|---|
| 1. | Constituents | % By Weight |
| | 1,2-dinitroxypropane | 76.0 |
| | 2-nitrodiphenylamine | 1.5 |
| | di-n-butylsebacate | 22.5 |
| 2. | Physical Properties: | |
| | Density | 1.2314 g/ml, 25° C |
| | Freezing point | −32° C (−25.6° F) |
| | Vapor pressure composition (calc) | 0.0877 mm at 25° C |
| | Vapor pressure of 1,2-dinitroxypropane | 0.09844 mm at 25° C |
| | Viscosity at 25° C | 4.04 centipoise |
| | Surface tension at 25° C per cm | 34.45 + 0.06 dynes |
| | Flash point | 120° – 122° C (248° – 251.6° F) |
| | Flaming point | 145° C (293° F) |
| 3. | Water content when dried | 0.008% |
| | Water content when water saturated | 0.026% |

4. Solubility of di-n-butylsebacate in water: at 27° C about 0.001% thus insoluble for practical purposes.

5. Characteristics of thermal decomposition:

a. Minimum pressure of ignition in nitrogen atmosphere according to window bomb tests: 335 psi; in a thrust motor: 120 psi b. Minimum pressure at which a thrust motor could be actuated thus far without pressure oscillations: 120 psi.

| (c) Performance: | Computed: | Measured: |
|---|---|---|
| Temperature before nozzle | 1390° K (2042° F) | 2250° F |
| Isp (1000 spi) | 207.8 sec | 207 sec |

d. L*, reactor pressure and space velocity, at which complete combustion is attained. Space velocity is defined as pounds per second of propellant per one cubic inch reactor space:

| L* | Pc (psi) | Space Velocity |
|---|---|---|
| 1622 | 400 | 0.002 |
| 350 | 975 | 0.0223 |
| 250 | 1115 | 0.035 |
| 205 | 1035 | 0.0405 |
| 150 | 1060 | 0.054 (four spray nozzles) |

6. Results of Safety Tests:

a. Standard bullet impact tests, glass-lined containers:
In 50 consecutive tests, no explosion (bullet-velocity 2700 ft/sec).
In steel containers: In 10 consecutive tests, no explosion.

b. Hitting the end instead of the side of the container, in steel containers with Winchester No. 220 SWIFT, with bullet velocity of 4100 ft/sec: in six consecutive tests, no explosion.

c. Standard card gap tests:
In glass-lined containers: No card at all, no explosions in 25 consecutive tests.
In steel containers without glass lining:
With one card: no ignition out of four tests
With no card: four ignitions out of 10 tests
This compares with Composition I with which in steel containers the card gap value is 3.8 cards.

d. Adiabatic compression tests: (Test No. 5) 14.5 kg cm (kilogram centimeter) in air, and 33 kg cm (kilogram centimeter) in argon, which compares with the following values for this test in air for:

| | |
|---|---|
| Composition I | 13.7 kg cm |
| Propylnitrate | 6.7 kg cm |
| Nitromethane | 11.5 kg cm |

VISCOSITY AND DENSITY OF COMPOSITION NO. II

| Temperature (° C) | Viscosity (centipoise) | Density (g/ml) |
|---|---|---|
| 25 | 4.04 | 1.2314 |
| 20 | 5.27 | 1.2366 |
| 15 | 7.10 | 1.2411 |
| −2 | 11.12 | 1.2512 |
| −5 | 12.57 | 1.2639 |
| −10 | 15.8 | 1.3047 |

COMPOSITION OF THE EXHAUST GASES AS DETERMINED BY GAS ANALYSIS FROM SAMPLES TAKEN BEFORE THE NOZZLE OF THE REACTOR

| | | % By Volume |
|---|---|---|
| Water $H_2O$ | | 12.6 |
| Hydrogencyanide, HCN | | 0.2 |
| Carbondioxide, $CO_2$ | | 10.65 |
| Carbonmonoxide, CO | | 37.8 |
| Hydrogen, $H_2$ | | 13.3 |
| Methane, $CH_4$ | | 11.5 |
| Nitrogen, $N_2$ | | 11.75 |
| Ethylene, $C_2H_4$ | | 0.35 |
| Nitrogenoxide, NO | | 1.55 |
| Nitrogensuboxide | | 0.4 |
| Average molecular weight M = 23.65 | | |
| $\frac{C_p}{C_v} = 1.262$ | | |
| Condensibles: | Water | 12.6 |
| Solubles: | $CO_2$ | 10.7 |
| | HCN | 0.2 |
| | Total | 23.5 |

EXAMPLE III

Composition III
Physical and Performance Data

| | | |
|---|---|---|
| 1. | Constituents | % By Weight |
| | 1,5-dinitroxypentane | 89.5 |
| | 2,nitrodiphenylamine | 1.5 |
| | di-n-butylsebacate | 9.0 |
| 2. | Physical Properties: | |
| | Density | 1.229 g/ml, 25° C |
| | Vapor pressure of composition (calc) | 0.0076 mm at 25° C |
| | Vapor pressue of 1.5-dinitroxypentane | 0.0045 mm at 20° C<br>0.0137 mm at 30° C |

EXAMPLE III-continued

Composition III
Physical and Performance Data

| | | |
|---|---|---|
| | Viscosity at 25° C | 6.48 centipoise |
| | Surface tension | 41.96 ± 0.06 dynes per cm |
| | Flash point | 155° C (311° F) |
| | Flaming point | 160° C (320° F) |
| 3. | Water content when dried | less than 0.1% |

4. Solubility of di-n-butylsebacate in water: at 27° C about 0.001%

5. Characteristics of thermal decomposition:

a. Minimum pressure at which a thrust motor could be actuated without pressure oscillations: 120 psi

| (b) Performance: | Computed: | Measured: |
|---|---|---|
| Temperature before nozzle | 1347° K (1964.6° F) | 2080° F |
| Isp (1000 psi) | 206 sec | 195 sec |

6. Results of Safety Tests:

a. Standard bullet impact tests by Bureau of Mines, in steel containers: In twenty-five consecutive tests, no explosions. (Bullet velocity 2700 ft/sec). In five consecutive tests with No. 220 Swift Winchester rifle, with bullet velocity 4100 ft/sec, no explosion.

b. Standard card gap tests:
In steel containers: No card at all, no explosions, in twenty consecutive tests.

c. Adiabatic compression Test No. 5: 19.4 kg cm (kilogram centimeter) in air, which compares with the following values for this test in air for:

| | kg cm/ml |
|---|---|
| Composition II | 14.5 |
| Composition I | 13.7 |
| Propylnitrate | 6.7 |
| Nitromethane | 11.5 |

VISCOSITY AND DENSITY OF COMPOSITION NO. III

| Temperature (° C) | Viscosity (centipoise) | Density (g/ml) |
|---|---|---|
| 25 | 6.48 | 1.229 |
| 20 | 6.72 | 1.233 |
| 15 | 8.04 | 1.239 |
| 10 | 9.87 | 1.244 |
| 5 | 11.67 | 1.246 |
| 0 | 13.91 | 1.253 |
| −10 | 22.47 | 1.265 |

COMPOSITION OF THE EXHAUST GASES AS DETERMINED BY GAS ANALYSIS FROM SAMPLES TAKEN BEFORE THE NOZZLE OF THE REACTOR

| Constitutents | | % By Volume |
|---|---|---|
| Water, $H_2O$ | | 13.3 |
| Hydrogencyanide, HCN | | 0.2 |
| Carbondioxide, $CO_2$ | | 8.2 |
| Carbonmonoxide, CO | | 37.0 |
| Hydrogen, $H_2$ | | 19.2 |
| Methane, $CH_4$ | | 12.1 |
| Nitrogen, $N_2$ | | 9.0 |
| Ethylene, $C_2H_2$ | | 0.2 |
| Nitrogenoxide, NO | | 0.1 |
| | | 99.9 |
| Average molecular weight M = 21.5 | | |
| $\frac{C_p}{C_v} = 1.291$ | | |
| Condensibles: | Water | 13.3 |
| Solubles: | $CO_2$ | 8.2 |
| | HCN | 0.2 |
| | Total | 21.7% |

The safety tests result in still better values than those for Composition II:

Card gap tests in steel containers:

No card at all, no explosion in 20 consecutive tests for Composition III while 0.4 card gap is the value for Composition II and 3.8 card gap is the value for Composition I.

| | |
|---|---|
| Composition III | 19.4 kg cm/ml |
| Composition II | 14.5 kg cm/ml |
| Composition I | 13.7 kg cm/ml |
| Propylnitrate | 6.7 kg cm/ml |
| Nitromethane | 11.5 kg cm/ml |

EXAMPLE IV

Composition IV

Composition IV consists of:

89.5% 2,4-dinitroxypentane 1.5% 2-nitrodiphenylamine 9.0% di-n-butylsebacate

The performance data are about the same as for Composition III.

The bullet impact tests in steel containers resulted in zero explosions out of 25 tests.

The card gap tests in steel containers gave a card gap value of one to two cards, and in teflon lined containers of zero cards. This compares with a card gap value of zero in steel containers for Composition III.

The adiabatic compression Test No. 5 gave a value of only 10.5 kg cm/ml for one sample, and 13.5 kg cm/ml for a second sample.

However, when preparing 2,4-dinitroxypentane for Composition IV, its heat test value had not been brought up to 15 minutes by treatment with sodium borohydride. When the values of the heat test had been brought up to 15 minutes, the safety tests were the same as for Composition III.

However, it should be emphasized that:

1. Compositions I, II, III and IV can be exploded when a sufficiently strong booster is employed. For example, with 50 grams of tetryl in the card gap tests, Composition III will not explode without any card. When completely confined it will explode with a booster of 100 grams of tetryl.

2. In bulk and at normal temperatures, none of the four Compositions can be ignited by a flame. However, if sufficiently finely dispersed by an efficient spray nozzle, the spray can be ignited in oxygen, and under special circumstances, also in air. Without oxygen, prepressurization is necessary for initiating the decomposition (burning) of the monopropellants when injected by a spray nozzle.

3. Thus far, the following methods of ignition have been successfully utilized:

a. Prepressurizing of the reactor by a solid igniter which ignites the spray at a minimum pressure of about 100 psi.

b. By a hydrogen-oxygen blow torch impinging onto the propellant spray without prepressurizing.

c. In oxygen atmosphere the spray can be ignited by an electric spark. The sequence is: oxygen, electric spark, propellant spray.

d. In air, by spraying the propellant onto a heating coil.

e. In vacuum hypergolic with chlorotrifluorine.

4. The decomposition frame, without the addition of air of an oxidizer, can be maintained only under pressure. Thus far, the lowest pressure at which a smooth decomposition flame was sustained was 120 psi for Composition II. For Compositions I, III and IV the value is about the same.

5. To obtain an immediate and smooth start of the decomposition in the gas generators, the necessary conditions for ignitions must be created in the reactor before the monopropellant is injected. Thus, the sequences are:

a. For ignition by a solid igniter: The solid igniter burns alone until the reactor is pressurized to about 200 psi, and then only the inlet valve for the liquid monopropellant spray is opened, and the spray is ignited by the impinging flame of the solid igniter.

b. Hydrogen-oxygen blow torch ignition: first the blow torch and then the propellant.

c. Oxygen-electric-spark ignition: first oxygen, then spark, then propellant spray.

d. First heating of the heating coil and then only spraying the propellant thereto.

Composition II has been successfully used for actuating a piston engine and a gas turbine. Carbon black formation was negligible, provided and appropriate reactor for the decomposition and reaction was used.

Composition II was subjected to the bonfire testing:

The first test was made in a polyethylene container. It was placed in a cut down 55-gallon drum, and a gasoline torch capable of heating 20 gallons of water in 20 minutes under identical conditions was inserted into the base of the drum. Approximately 10 minutes after starting the torch, the polyethylene container caught fire and burned through. The propellant spewed out, extinguishing the gasoline flame. The polyethylene container continued to burn until completely consumed, at which time the gases from the monopropellant ceased to burn. After cooling the site, large puddles of monopropellant were found on the ground within a 10-foot circle of the drum. There were no audible or visual signs of pressure buildup.

The second test was performed on one of the 5-gallon metal containers. The method was identical to that used in the first test. Ten minutes after starting the gasoline torch, the 15-psi rupture disc opened and gases escaped at a rapid rate. Within seconds the gases ignited. The top of the container ruptured and combustion appeared very stable in the air. A few minutes later the bottom ruptured, spilling monopropellant on the gasoline torch and cooling the flame. On examining the site after cooling, large puddles of monopropellants were found within a 10-foot circle. Both top and bottom of the container had ruptured.

The third test used the remaining 5-gallon metal container of monopropellant. A pit was dug and the container was placed on two timbers. The pit then filled with wood scraps and soaked with gasoline. The gas-soaked wood was ignited. After 15 minutes the only reaction noticed was the burning off of gases in the air from the decomposing propellants spewing from the 15-psi rupture disc port. This reaction continued until the fire burned out. All the monopropellant was found consumed and the container was scorched and paint burned off. Head and bottom of the container were intact and indicated no signs of rupture.

From the comparison of the four given examples, it results that Composition II, presented in Example II, is the preferred embodiment.

It is obvious that diluents other than normal dibutylsebacate and tributyrin can be used without departing from the gist and spirit of this invention. For example, triacetin may be used. However, the solubility of triacetin in water is 7% by weight and, therefore, cannot be used as a diluent on board ships. Moreover, diethylhexyl-sebacate known as Plexol, may be used. However, this compound is not completely soluble in the dinitrate esters in all propulsions. It is obvious that also other dinitrate esters than the given examples can be used.

For example, ethylene glycol dinitrate has a low vapor pressure. However, its oxygen balance is completely balanced and, therefore, an explosion in the gaseous phase is readily obtained although the compound has a very low vapor pressure.

Both 1,2-butane diol and 2,3-butane diol were nitrated, and from both 1,2-dinitroxybutane and 2,3-dinitroxybutane the following compositions were mixed:

83.5% 1,2- and 2,3-dinitroxybutane, respectively
1.5% 2-nitrodiphenylamine
15.0% tributyrin The 83.5% concentration of dinitroxybutane corresponds to the 76% concentration of the dinitroxypropane inasmuch as the percentage of available oxygen for complete combustion is present in the mixture.

Samples of the 83.5% dinitroxybutane mixtures were subjected to the adiabatic compression Test No. 5.

The results were not quite as good as the results with Compositions II, III and IV. This might be explained by the fact that the butyl diol nitrates were not purified by the new methods developed at a later date.

It is also obvious that mixtures of the dinitrate esters can be used and also mixtures of dinitrate esters and trinitrate esters, and also solutions of solid dinitrate esters in liquid dinitrate esters. It is also obvious that the nitrate esters of other isomers of 1,5-pentanediol and 2,4-pentanediol can be used to mix a composition containing:

89.5% dinitroxypentane
1.5% 2-nitrodiphenylamine
9.0% di-n-butylsebacate 2-nitrodiphenylamine is added as stabilizer for possible reaction with $NO_2$ which might be formed by decomposition.

However, accelerated aging tests of Composition II at 50° C for 3 years have resulted in no change of composition. The concentration of 2-nitrodiphenylamine was unchanged, and so were all physical properties.

The novelty of the invention in its broadest form consists of a mixture of an aliphatic dinitrate ester such as, for example, dinitroxyethane, dinitroxypropane, dinitroxybutane and dinitroxypentane and mixtures of same and a water insoluble diluent of low vapor pressure such as, for example, tributyrin, di-normal-butyl sebacate and di-2,ethyl-n-hexyl-sebacate and mixtures of same in such proportions that the oxygen balance of the mixture of the nitrate esters and the diluents is kept between about 30% and 50% to which mixture I prefer to add about 1,5% by weight of 2-nitrodiphenylamine as a stabilizer against possible hydrolization of the nitrate esters. The term "Oxygen Balance" I want to have understood to mean the quantity of oxygen present in the molecule, expressed in percentage of the oxygen which is needed for complete combustion to carbon dioxide and water.

EXAMPLE V

Composition V

Composition V consists of
84½% 1,2-dinitroxypropane
1½% 2-nitrodiphenylamine
14% di-n-butylsebacate The specific impulse of the exhaust gases of decomposition when expanding from 1000 psi to 15 psi, $I_{sp}$ = 218 seconds and their temperature before the nozzle is 2780° F. Thus, this mixture is of much greater energy content as Composition II of Example II. However, the card gap value is eight cards at 25° C, as against 0.4 cards for Composition II, and the critical diameter in steel pipes is about 3/8 of an inch instead of 1.25 inches for Composition II.

The value of the oxygen balance as defined herein before is 45.2% instead of 37.42% which is the value for Composition II. It is, of course, also possible to work with a mixture of lower value for the oxygen balance than that of Composition II, i.e. 37.42%. For example, Composition III presented as Example III has an oxygen balance of 33.26% and, therefore, results in a lower temperature of the exhaust gases before the nozzle of 2150° F instead of 2250° F for Composition II. It is possible to increase the proportion of diluent or diluents added until the oxygen balance is reduced to 30%. However, this implies that the exhaust gases will contain carbon black. Where gases containing carbon black are not detrimental, such mixtures can be used, and where the safety requirements are less stringent the value for the oxygen balance can be increased to about 50%.

I prefer to select a compromise of these two limits of 30% and 50% and to work with Composition II the value for the oxygen balance of which is 37.42% as defined hereinbefore.

It is self explanatory that the diluents can be mixtures of the diluents presented as examples. For example, one may used a mixture of di-n-butyl sebacate and di-2,ethyl-n-hexyl sebacate, and it is also possible to use mixtures of the nitrate esters without departing from the gist and spirit of the invention.

The contents of the exhaust gases of the monopropellants after decomposition and reaction are indicated by Mol per cent or percentage by volume. All other concentrations in the disclosure and in the claims are to be understood to be percentage by weight if not otherwise indicated.

What is claimed is:

1. A liquid monopropellant comprising an aliphatic dinitrate ester selected from dinitroxyethane, dinitroxypropane, dinitroxybutane and dinitroxypentane and mixtures thereof with di-2, ethyl-n-hexyl sebacate.

2. A liquid monopropellant comprising a mixture of dinitroxypropane and a diluent selected from tributyrin, di-n-butyl sebacate and di-2, ethyl-n-hexyl sebacate.

* * * * *